United States Patent [19]

Markowitz et al.

[11] Patent Number: 4,950,426

[45] Date of Patent: Aug. 21, 1990

[54] GRANULAR FILL MATERIAL FOR NUCLEAR WASTE CONTAINING MODULES

[75] Inventors: Joseph M. Markowitz, Baldwin Borough; Daniel C. Meess; James B. Wright, both of Murrysville, all of Pa.

[73] Assignee: Westinghouse Electric Corp., Pittsburgh, Pa.

[21] Appl. No.: 331,341

[22] Filed: Mar. 31, 1989

[51] Int. Cl.[5] ..... G21F 9/12; G21F 9/24; G21F 5/00; G21F 9/00

[52] U.S. Cl. ..... 252/633; 250/506.1; 250/507.1; 252/628; 405/128; 405/129; 376/272

[58] Field of Search ..... 252/628, 633, 631; 250/506.1, 507.1; 405/128, 129, 270

[56] References Cited

U.S. PATENT DOCUMENTS

| | | | |
|---|---|---|---|
| 3,196,619 | 7/1965 | Shock | 252/626 |
| 3,274,784 | 9/1966 | Shock | 252/626 |
| 4,350,461 | 9/1982 | Valiga et al. | 405/128 |
| 4,377,509 | 3/1983 | Haynes et al. | 252/633 |
| 4,416,810 | 11/1983 | Noakes | 252/628 |
| 4,424,903 | 1/1984 | Knieper et al. | 206/525 |
| 4,681,706 | 7/1987 | Mallory et al. | 252/633 |
| 4,770,715 | 9/1988 | Mandel et al. | 215/315.2 |
| 4,775,494 | 10/1988 | Rowsell et al. | 252/628 |
| 4,778,627 | 10/1988 | Doan | 252/631 |
| 4,778,628 | 10/1988 | Saha et al. | 252/633 |
| 4,781,860 | 11/1988 | Doan | 252/628 |
| 4,784,802 | 11/1988 | Mallory et al. | 250/506.1 |
| 4,842,774 | 6/1989 | Golden | 252/633 |
| 4,844,840 | 7/1989 | Feizollahi | 252/633 |

*Primary Examiner*—Howard J. Locker

[57] ABSTRACT

A granular fill material is disclosed for use in a storage module for the storing of nuclear and hazardous waste materials. The waste materials are packaged in a waste container which is in turn deposited within the storage module, thereby creating a void space between the waste package or packages and the interior sidewalls of the module. The filler material is reintroduced within the module to fill within this void space, to immobilize the waste containers within the module, and to provide a physical and chemical barrier around the waste containers. The granular filler material comprises a sand filler, an absorbent clay such as Wyoming bentonite, and an organic liquid absorbent material such as Fuller's earth. Other constituents that can be mixed in the granular fill material are an acid neutralizing material such as quicklime or slaked lime, and a getter material for absorbing radionuclides. The granular fill material also advantageously enhances the retrievability of waste packages within the module should such retrieval become necessary.

20 Claims, 1 Drawing Sheet

GRANULAR FILL MATERIAL FOR NUCLEAR WASTE CONTAINING MODULES

TECHNICAL FIELD OF THE INVENTION

This invention generally relates to storage modules into which containers of nuclear waste are deposited, and is specifically concerned with a granular fill material used to fill the void space created between the waste containers and the inner walls of the storage module. The granular fill material not only effectively holds the waste containers in place within the module, but also provides an active leakage barrier which is capable of chemically and physically immobilizing wastes and retaining fluids that might otherwise escape from the waste containers or which might attempt to enter the modules from outside. The granular fill material also helps to prevent subsidence from occurring in the ground surrounding the modules in the event that the engineered barriers around the waste should fail.

BACKGROUND OF THE INVENTION

Systems for the packaging and disposal of nuclear wastes are known in the prior art. Some of these systems utilize concrete storage modules which contain and store containers of radioactive waste that have been deposited and immobilized therein. Examples of such modules are disclosed in U.S. Pat. No. 4,681,706, assigned to the Westinghouse Electric Corporation. After these modules have been loaded with waste containers and closed up, they may be stored in a radioactive waste facility. However, when waste containers are deposited in the storage module, a void space is often created within the module. This void space is undesirable because liquids originating either from the waste within the packages or from outside the storage module can collect in the void space and weaken the waste containers or the walls of concrete module. Ultimately, these liquids can provide a path for the migration of radionuclides out of the module.

Previously in such prior art storage modules, the void space created between the waste containers and the module inner wall was filled with a cementitious material that would harden into a continuous solid. Typically, a grout formed from a Portland-based cement was used for this purpose. After the cement or grout was allowed to harden, the completed modules were carried from the area where they were loaded within a disposal site for storage for an indefinite period of time. The modules must be stable and durable structures, since storage periods of up to 200 years or more are necessary, depending on the type of radioactive waste and its half-life.

A common method of disposing the modules is to bury them in specially prepared underground disposal sites. Such a disposal site may comprise a trench having a flat floor with a monitoring system incorporated therein to periodically monitor if any water is within the trench and to determine whether or not radioactive substances have somehow leaked from the modules. A layer of gravel is deposited over the floor for drainage, and the modules are stacked over the gravel layer in mutuallY adjoining columns. The stacked columns of modules are then covered by a plurality of layers of soils and sands. An example of such a disposal site is also disclosed in U.S. Pat. No. 4,681,706. After the stacked modules have been completely covered over, they may be stored indefinitely until the radioactive material contained within them decays into harmlessness.

Although the storage modules are formed of reinforced and relatively thick concrete to make them mechanically strong and impervious to water, a problem can arise if the concrete forming the module should develop a crack. Such a crack might result from a seismic disturbance, a shifting of the modules within the soil, from subsidence, or a dropping of one of the modules during the stacking operation. The cementitious grout used as an additional barrier to immobilize the radioactive package within the module could also develop a crack which could then allow water and possibly waste material to pass through the walls of the storage modules. Thus, while a concrete module with a cementitious grout is, under most circumstances, capable of safely storing radioactive waste containers for an indefinite period of time, there are conditions which could result in a crack that could leak to a leakage condition. If such a leak should develop, then the monitoring system should notify an operator at the disposal site that an unacceptable situation has developed which needs to be remedied. The storage modules could be uncovered and the faulty storage module responsible for the leakage could then be removed from the site for repair or replacement. However, the hardened grout in such a module could hinder the removal of the leaking waste packages, making it necessary to break up the hardened grout and possibly even the walls of the storage module and the waste containers just to get at the waste. Another shortcoming associated with the use of grout is the tendency of the some of the lighter weight waste containers to float upwardly when the heavy grout is poured into the module. When this occurs, it becomes necessary for an operator to push the container or containers back down into the module interior before the grout hardens so that the module lid will fit properly. The added step caused by such unwanted floating slows up the module packing procedure, and increases the amount of radiation exposure to the operators.

Before the utilization of storage modules as described above, other unsatisfactory methods for the permanent disposal of nuclear waste had been attempted. One such method included the simple containment of nuclear waste in 55-gallon steel drums which were transported to a remote burial site. Such a system turned out to be entirely inadequate because water would accumulate around the drums due to the "bathtub effect" and corrode and collapse them, which could result in the radioactive contamination of the ground water coming in contact with the drums. Other methods of disposal have dropping barrels or modules to the ocean floor for indefinite storage. Unfortunately, these methods are disadvantageous in that the barrels or modules are subject to corrosion and breakage due to corrosive salts and high ocean pressures which can result in leakage of the radioactive wastes. One type of packaging for ocean disposal of radioactive wastes is disclosed in U.S. Pat. No. 4,377,509, issued Mar. 22, 1983 to Haynes et al., wherein a concrete shell is provided with waste receptacles such as steel drums with a filler disposed between the drums and the shell. When this concrete shell is dropped to the ocean floor, water enters the shell and reacts with the filler to form a hardened cement-like material that immobilizes the waste drums within the shell, while a pressure compensation system prevents the shell from collapsing under ocean pressures as the package drops. However, as in the above-discussed storage modules, the package is stored for an indefinite period with a hardened cement filler between the cement shell and the waste receptacles, and is thus subject to the same disadvantages relating to the potential for cracks and the difficulty in retrievability associated with a cement filler.

Other storage methods are known for permanently storing waste material in a subterranean depository which fixes the waste material within a solid formed by adding a composition to liquid waste which causes the liquid waste to solidify. These methods are likewise not completely unsatisfactory in that there is no account taken for the leaching of waste material into the surrounding terrain. Examples of such methods are disclosed in U.S. Pat. Nos. 3,196,619 dated July 27, 1965 and 3,274,784 issued Sept. 24, 1966. Moreover, such methods provide no way to retrieve the material if a problem arises.

Clearly, there is a need for a packaging and storing system and module which eliminates the void space but which allows the waste containers to be easily retrieved should a problem arise or a new technology develop. Ideally, such .a module should include a crack-proof barrier capable of chemically and physically arresting the flow of liquid waste, to prevent the migration of radioactive nuclides into the surrounding ground. Finally, it would be desirable if the installation of the void-eliminating barrier did not cause any unwanted floating of the waste containers within the module during the packing operation.

SUMMARY OF THE INVENTION

In its broadest sense, the invention is a granular or particulate filler which provides easy retrievability of the waste package from a storage module, and occupies the void space created between the waste package and the module to act as a barrier that is capable of chemically and physically arresting liquids. The granular fill not only immobilizes the waste package within the module, but also provides for the immobilization of wastes themselves in the event the waste packages become damaged. The granular fill immobilizes and retains radioactive or hazardous wastes which may be carried by mineral assets or salt solutions, organic solvents and concentrated bases, and does not cause any unwanted floating of the waste containers within the module when installed therein.

The granular fill includes sand as a base filler material of an amount ranging from 20% to 80%, a bentonite clay material that can absorb several times its own volume of water and can absorb nuclides in solution of an amount between 10% and 40%, and from 10% to 40% of Fuller s earth which is a solid absorbent material that has an affinity for organic solvents to supplement the bentonite. The granular fill material may also include an acid neutralizing material of a particulate solid of up to 25%. One such material contemplated is quicklime which will provide the acid neutralization by changing the mineral acids from fluid leakage into calcium salts, and will absorb water, causing the quicklime to be converted to slaked lime, which will still act in an acid neutralizing capacity. Alternatively, slaked lime can be simply added as the acid neutralization material, which would eliminate the heat release incidental to the reaction of quicklime with water. The granular fill may also contain a material known as getter for adsorbing radionuclides to prevent the radionuclides from migrating from the wastes.

The present invention includes the provision of a storage module with an interior cavity defined by concrete reinforced sidewalls and a bottom, wherein at least one waste container is provided within the interior cavity and the granular filler material is provided in the void between the waste container and the module walls, and a lid is provided to removably close off the filled interior cavity. The granular filler material would comprise at least sand, a water absorbent clay and an organic liquid absorbent material. The water absorbent clay may be bentonite and the organic liquid absorbent may be Fuller's earth. As has been previously indicated, an acid neutralizer and a getter can also be advantageously included.

Finally, the present invention relates to a method storing at least one waste container by placing the waste container in an internal cavity of a storage module, wherein the storage module is comprised of concrete reinforced sidewalls, a bottom, and a removable lid; filling the void created around the waste container within the internal cavity with a granular fill material for substantially immobilizing the waste container; packing the granular fill material within the module about the waste container; closing off the internal cavity by removably securing the concrete lid to the storage module, and storing the storage module containing the granular fill material and the waste container at a waste disposal site. Additionally, the granular fill material is made by mixing together sand, bentonite clay, and Fuller's earth as above, and may include an acid neutralizer and a getter as other constituents.

The above-noted method of storing contemplates placing either one or a plurality of waste containers in the storage module, which may be steel drums or low level boxes.

DETAILED DESCRIPTION OF PREFERRED EMBODIMENT

Figure 1:
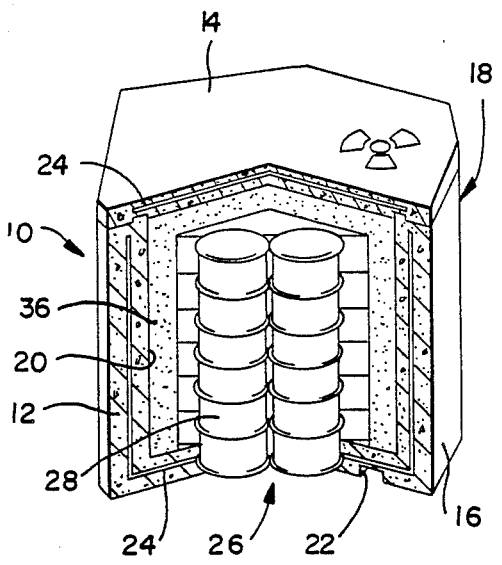
FIG. 1 is a perspective, cutaway view of a packed storage module including drums in accordance with the present invention.

With reference now to FIGS. 1 through 4, wherein like reference numerals designate like components throughout all of the several figures, a storage module 10 is described as follows:

The storage module 10 includes a container 12 formed of reinforced concrete and defining a bottom and sidewalls. The container 12 is closed off, as illustrated in each of the figures, by a lid 14 placed atop the upper most edges of the container 12. The lid 14 is removably attached to the container 12 for purposes as will become more apparent below, by way of an upstanding ridge 13 on container 12 and a parametric recess 15 on the lid 14. Such a connection provides a secure placement of the lid 14 on the container 12, wherein the weight of lid 14 adequately ensures that the lid 14 will not fall off, while the lid 14 can be removed with the aid of equipment (not shown), such as hoist or crane.

For the sake of facilitating a stacking relationship of the storage modules 10 in adjacent columns, the storage modules 10 are shaped as a hexagonal prism. Each of the sides of the hexagon is illustrated as substantially flat sides 16, and between each of the sides 16 is corner side 18. When the storage modules 10 are stacked, the sides 16 of adjacent modules 10 abut one another to define a honeycomb-type arrangement when viewed as a plan view from above. The corner sides 18 make small gaps between the abutting modules 10 when they are stacked in a module array, wherein the small spaces are large enough to receive recovery tools for the retrieval of one of the modules should such recovery become desirable. However, the formed spaces are small enough so that when the module array is covered in a burial facility, no significant amount of soil subsidence will occur.

In order to facilitate movement of the storage modules either before they are filled or afterward, the bottom of each container 12 is provided with forklift grooves 22, of which one is clearly illustrated in each figure. Thus, the module can be effectively handled by a conventional forklift or a shielded forklift as necessary, when dealing with high levels of radiation. To strengthen the module 10, a steel reinforcing mesh 24 is formed within the walls of both the container 12 and the lid 14. The reinforcing mesh 24 is provided within the concrete at the time when the container 12 and lid 14 are formed, as is conventionally known.

Figure 2:
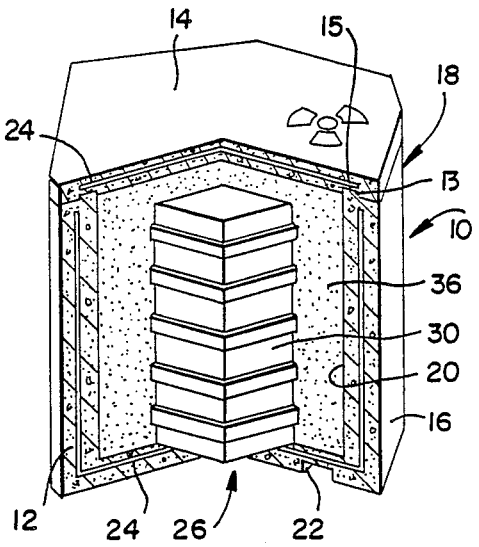
FIG. 2 is a perspective, cutaway view of another packed module with low specific activity boxes in accordance with the present invention.
Figure 3:
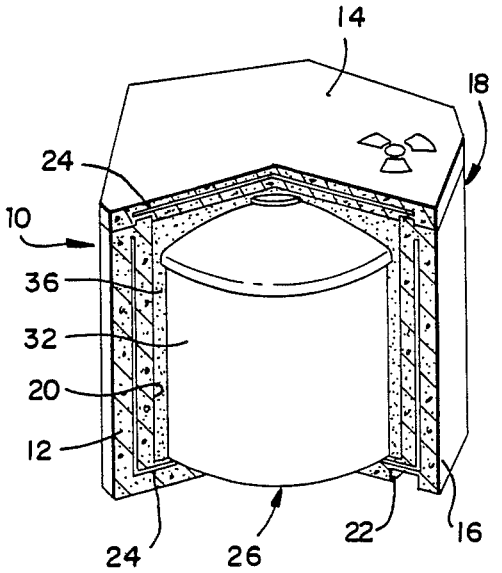
FIG. 3 is another perspective, cutaway view of a packed module with a high integrity container in accordance with the present invention.
Figure 4:
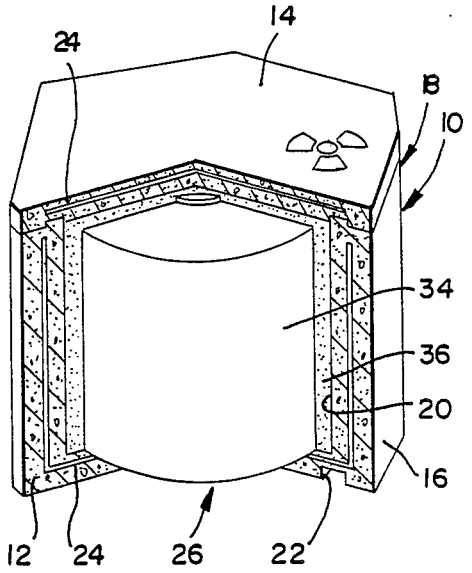
FIG. 4 is yet another perspective, cutaway view of a module packed in accordance with the invention with a liner.

Within the container 12, the sidewalls 16 and 18 define an interior base 20, which is preferably cylindrical. In the preferred embodiment, the walls of the container 12 are at least three inches thick and the cylindrical interior space 20 of the container 16 is at least seventy-five inches in diameter. Within the interior space 20, at least one waste container 26 is provided. In FIG. 1, several stacks of steel drums 28 are illustrated, wherein there are preferably seven stacks of two drums per stack. In FIG. 2, a stack of low specific activity boxes 30 is illustrated wherein there may be several stacks with a plurality of boxes per stack depending on the size of each box 30. A high integrity container 32 is illustrated in FIG. 3, wherein only a single container is illustrated for the purpose of holding a relatively large amount of waste material. It is of course understood that each of the above-mentioned containers, whether being steel drums 28, low specific activity boxes 30 or the integrity container 32 is designed in accordance with the type of waste to be held therein in accordance with well known standards. For example, the walls of the high integrity container 32 are made of sufficient thickness and of the proper material for the storage of highly radioactive wastes. As an additional safeguard, and as illustrated in FIG. 4, a liner 34 can be included. Within the liner 34, other waste containers can be provided, wherein the liner 34 provides an additional barrier layer.

A void space is created in the cylindrical interior space 20 between the waste containers or packages 26 and sides of the container 12, which according to the present invention is filled with a particulate filler granular fill material 36. This granular fill material is packed around the waste containers of packages 26 so that the waste containers 26 are substantially immobilized within the module 10 and the waste packages 26 will not move around within the module 10 during transportation and disposal. In this regard, the granular fill material 36 is basically similar to a cementitious grout, which has been used in the prior art, for immobilizing waste packages within a storage module. However, the granular fill of the present invention provides additional advantageous features which could not be obtained by the use of hardenable material such as cement. The granular fill 36 occupies the void space to act as an active barrier, which is capable of chemical and physical action should any liquid either enter the module from outside at the disposal site or as a result of leakage of waste from the waste package therein. Moreover, the granular fill enhances the retrievability of the waste packages of the module at any point in the future, if a problem were to arise, i.e. leakage, or if technology advances to a point where the waste could be treated in a better way. The granular fill material 36 also will occupy all void spaces around each of the waste packages therein, wherein as viewed in FIG. 1, the granular fill 36 effectively fills between the columns drums 28 as well as the area between the drums and the walls of the container 12. Finally, the granular fill 36 will help to prevent subsidence from occurring around the burial site if the walls of the container should break. Thus, the security of the waste packages in the modules 10 are guaranteed, while still providing easy retrievability of a waste container should it become desirable.

To act as a barrier capable of chemical and physical action, the granular fill is comprised of a number of constituents which together create a barrier for immobilization of wastes and retention of liquids that may enter the granular fill area of the module 10. The first material, used a base medium, is sand in an amount arranging from 20% to 80%, which provides the bulk of the filler into which the other constituents can be mixed. Preferably, the granular fill will contain approximately 50% by volume of sand. Another major component of the granular fill is a bentonite clay of an amount from 10% to 40% by volume. Preferably, the bentonite clay is of the type known as Wyoming bentonite, which is a montmorillonite clay. The Wyoming bentonite is capable of absorbing liquids, and in fact can absorb several times its own volume of water, which is a main ingredient of any liquid leakage. Thus, any liquids leaking from a waste package 26 or any element of the waste which may leach into water that gets into the module 10 from the environment can be absorbed. Wyoming bentonite is also capable of adsorbing nuclides in solution, which is important when storing radioactive wastes. Another major constituent of granular fill 36 is a material known as Fuller's earth in an amount from 10% to 40% by volume for the purpose of absorbing organic liquids. Fuller's earth is a grain clay consisting of hydrated aluminum silicates which can be provided as a particulate solid absorbent material having an affinity for organic solvents to supplement the Wyoming bentonite.

The granular fill 36 may also contain a particulate solid for acid neutralization in an amount from 0% to 25%. One such particulate solid preferably is quicklime, CaO. The quicklime will provide acid neutralization to effectively chain mineral acids released from fluid leakage into calcium salts. Moreover, the quicklime also will absorb water, wherein the quicklime will be converted to slaked lime, $CA(OH)_2$. The slaked lime will then still retain the acid neutralizing capacity for the granular fill. Alternatively, slaked lime $CA(OH)_2$, can be the original acid neutralizing ingredient mixed with the granular fill wherein the slaked lime will act as an effective acid neutralizer while the heat release incidental to the reaction of quicklime, CaO, with water would be eliminated. However, the water absorbing quality would likewise be removed.

Additionally, the granular fill may also contain a material known as a getter of an amount from 0%–25%. This getter material adsorbs radionuclides by capturing the radionuclides on an external surface of the resin beads. Thus, radionuclides can be prevented from migrating from the waste. The getter is selected to supplement the adsorptive capacity of the bentonite, which is already capable of waste adsorption of nuclides in solution. Preferably, the getter is selected from any of the minerals of the zeolite group of minerals, such as analcime, chabazite, natrolite, and stilbite.

For each of the constituent materials and the base sand of the granular fill 36, it is preferable that each of the materials is of a similar fineness relative to each other. This facilitates the mixing of the constituents as well as the filling of the void space within a storage module 10 and the packing of the granular fill around the waste containers. When packing the granular fill, it is contemplated to simply tap the granular fill tightly within the module 10 or to additionally utilize a vibrator.

Thus, it can be clearly seen how the granular fill 36 will enhance retrievability in the event that a waste package needs to be removed from module 10 in contradistinction to a cementitious material or grout. The granular fill can actually provide a greater shielding than a grout or cement if the granular fill is denser as it is packed within the module 10. Furthermore, if a leak path is created for radionuclides to migrate, the liquid would necessarily leak into the entire volume of the granular fill wherein the granular constituents would prevent any radionuclides from migrating. If concrete with a cement grout were to crack, a leak path would be created for radionuclides to migrate to the surrounding environment, the prevention of which is one of the major goals achieved by the present invention. Although not shown in any of the several figures, the storage module 10 can be used to hold any number of other types of hazardous wastes and wastes of varying degree of radioactivity from a nuclear power plant. Specifically, the containers for the wastes would be designed in accordance with the waste product stored therein. The granular fill 36, advantageously can be packed to surround any shape of container and act as an effective barrier in both the physical and chemical sense for prevention of waste elements, such a radionuclides, from the waste packages. Other granular material constituents could also be added to the granular fill in appropriate proportion if it were necessary to either counteract or absorb a specific element not provided for above with regard to nuclear waste.

We claim:

1. A granular, particulate fill material for use in a storage module to substantially immobilize a nuclear waste package within the module by filling a void between the package and the module, said granular fill comprising a mixture of sand filler of an amount ranging from 20% to 80% by volume, bentonite clay of an amount between 10% to 40% by volume for absorbing water and adsorbing nuclides in solution, Fuller's earth of an amount between 10% to 40% by volume for absorbing organic liquids, and a radionuclide adsorptive getter material of an mount up to 25% by volume, wherein said granular fill remains in a particulate form in the storage module while the storage module is indefinitely stored.

2. The granular fill material of claim 1, further including an acid neutralizing material up to 25%.

3. The granular fill material of claim 2, wherein said acid neutralizing material includes quicklime which adsorbs water and neutralizes acids.

4. The granular fill material of claim 2, wherein said acid neutralizing material includes slaked lime.

5. The granular fill material of claim 1, wherein said getter is zeolite mineral.

6. A storage module for storing nuclear waste material having an interior cavity defined by sidewalls and a bottom, integrally formed of concrete, and a led removably closing off said interior cavity, wherein at least one waste container is provided within said interior cavity, and a granular, particulate filler material is provided to at least partially fill a void defined between said waste container and said module, said granular filler material comprising a mixture of from 20% to 80% by volume of a sand filler, a water absorbent clay of between 10% and 40% by volume, and an organic liquid absorbent Fuller's earth material of an amount from 10% to 40% by volume, wherein said granular fill remains in a particulate form after said lid closes off the interior of said waste container while said waste container is indefinitely stored.

7. The storage module of claim 6, further including an acid neutralizing material of an amount up to 25% of the total granular fill.

8. The storage module of claim 6, wherein said acid neutralizing material includes quicklime for neutralizing acids and absorbing water.

9. The storage module of claim 6, wherein said acid neutralizing material includes slaked lime.

10. The storage module of claim 6, further including a getter material that absorbs radionuclides of an amount up to 25% of the total granular fill.

11. The storage module of claim 7, further including a getter material of an amount up to 25% of the total granular fill, that adsorbs radionuclides.

12. The storage module of claim 10, wherein said getter material is a zeolite mineral.

13. The storage module of claim 11, wherein said getter material is a zeolite mineral.

14. The storage module of claim 6, wherein said water absorbent clay comprises of bentonite.

15. The storage module of claim 14, further including an acid neutralizing material of an amount up to 25% of the total granular fill comprising at least one of quicklime and slaked lime, and a getter material that adsorbs radionuclides of an amount up to 25% of the total granular fill, comprising a zeolite mineral.

16. A method of storing at least one waste container having nuclear waste material therein, said method comprising the steps of:

placing said waste container in an internal cavity of a storage module, said internal cavity being defined by sidewalls and a bottom formed from concrete of said storage module, there being a void between said waste container and said module;

filling said void, at least partially, with a granular, particulate fill material to substantially immobilize said waste container within aid module;

packing said granular fill material around said waste container;

closing off said internal cavity defined within said storage module by removably securing a concrete lid to said storage module; and storing said storage module for an indefinite period of time with said waste container and said granular fill material at a waste disposal site, wherein said granular filler remains in particulate form after said storage module is closed off and said granular filler is made by mixing together a sand filler of an amount ranging from 20% to 8-% by volume, bentonite clay of an amount between 10% to 40% by volume for absorbing water and adsorbing nuclides in solution, and Fuller's earth of an amount between 10% to 40% by volume for absorbing organic liquids.

17. The method of claim 16, wherein said granular fill material is further made by mixing an acid neutralizer as another constituent comprising at least one of the group of quicklime and slaked lime.

18. The method of claim 17, wherein said granular fill material further comprises a getter that includes a zeolite mineral.

19. The method of claim 16, wherein a plurality of waste containers are placed within said internal cavity, and said granular fill material is filled in the void around said plurality of waste containers to substantially immobilize all of the waste containers.

20. The method of claim 16, wherein said void is virtually completely filled with said granular fill material, so that when said lid closes off said internal cavity, the storage module is substantially completely full.

* * * * *